US009127522B2

(12) United States Patent
Kent et al.

(10) Patent No.: US 9,127,522 B2
(45) Date of Patent: Sep. 8, 2015

(54) METHOD AND APPARATUS FOR SEALING AN ANNULUS OF A WELLBORE

(75) Inventors: Ian K. Kent, Okotoks (CA); Stewart R. Hollett, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 915 days.

(21) Appl. No.: 13/056,958

(22) PCT Filed: Feb. 1, 2010

(86) PCT No.: PCT/US2010/022755

§ 371 (c)(1),
(2), (4) Date: Jan. 31, 2011

(87) PCT Pub. No.: WO2011/093902

PCT Pub. Date: Aug. 4, 2011

(65) Prior Publication Data

US 2011/0259603 A1 Oct. 27, 2011

(51) Int. Cl.
*E21B 23/06* (2006.01)
*E21B 33/12* (2006.01)
*E21B 34/14* (2006.01)

(52) U.S. Cl.
CPC ..... *E21B 23/06* (2013.01); *E21B 33/12* (2013.01); *E21B 34/14* (2013.01)

(58) Field of Classification Search
CPC . E21B 2034/007; E21B 34/14; E21B 23/004; E21B 23/006; E21B 34/00; E21B 34/12
USPC ..... 166/373, 374, 381, 386, 316, 318, 166/332.1, 332.4, 334.1, 334.4
See application file for complete search history.

(56) References Cited

U.S. PATENT DOCUMENTS 3,527,297 A 9/1970 Todd
3,948,322 A * 4/1976 Baker ..... 166/289
(Continued)

FOREIGN PATENT DOCUMENTS

WO WO2007/060449 5/2007
WO WO2011/057416 5/2011

OTHER PUBLICATIONS

Notification Concerning Transmittal of International Preliminary Report on Patentability (2 pages); and Written Opinion of the International Searching Authority (7 pages), mailed Aug. 16, 2012, for related international application PCT/US2010/022755.
(Continued)

*Primary Examiner* — Elizabeth Gitlin
(74) *Attorney, Agent, or Firm* — Scott Richardson; Fish & Richardson P.C.

(57) ABSTRACT

A well system (100) includes a production string (130) adapted to extend from a wellhead (120) to a subterranean zone (110). The production string (130) includes one or more joints of tubing comprising a bore; a seal (150) actuable by a specified pressure in the bore to substantially prevent fluid communication in an annulus (140) between a first portion of a wellbore (115) and a second portion of the wellbore (115), and an intervention sub (200) comprising a body (210) and a plurality of ports (228, 230) adapted to allow fluid communication between the bore and the annulus (140). The annulus is disposed between an exterior surface of the production string (130) and the wellbore (115). The intervention sub (200) further includes a seat (226) adapted to receive a plug (224) from the terranean surface (105) and seal the bore to substantially prevent fluid communication through the ports (228, 230).

18 Claims, 7 Drawing Sheets

(56) References Cited

U.S. PATENT DOCUMENTS

| | | | |
|---|---|---|---|
| 4,842,062 | A | 6/1989 | Schneider et al. |
| 5,332,038 | A | 7/1994 | Tapp et al. |
| 5,368,098 | A | 11/1994 | Blizzard, Jr. et al. |
| 5,810,084 | A | 9/1998 | Echols |
| 5,826,652 | A | 10/1998 | Tapp |
| 6,244,567 | B1 | 6/2001 | Robins |
| 6,634,428 | B2 | 10/2003 | Krauss et al. |
| 6,923,255 | B2 | 8/2005 | Lee |
| 7,021,389 | B2 | 4/2006 | Bishop et al. |
| RE39,209 | E | 8/2006 | Barton |
| 7,150,326 | B2 | 12/2006 | Bishop et al. |
| 7,857,052 | B2 | 12/2010 | Giroux et al. |
| 7,861,788 | B2 | 1/2011 | Tips et al. |
| 7,866,402 | B2 | 1/2011 | Williamson, Jr. |
| 7,909,095 | B2 | 3/2011 | Richards et al. |
| 7,926,573 | B2 | 4/2011 | Swan et al. |
| 7,950,461 | B2 | 5/2011 | Schrader et al. |
| 8,096,363 | B2 | 1/2012 | Williamson, Jr. |
| 2004/0118564 | A1 | 6/2004 | Themig et al. |
| 2006/0124310 | A1 | 6/2006 | Lopez de Cardenas et al. |
| 2006/0243455 | A1 | 11/2006 | Telfer et al. |
| 2007/0084605 | A1 | 4/2007 | Walker et al. |
| 2007/0240883 | A1* | 10/2007 | Telfer ..... 166/375 |
| 2008/0000697 | A1 | 1/2008 | Rytlewski |
| 2008/0066924 | A1 | 3/2008 | Xu |
| 2011/0209868 | A1 | 9/2011 | Dusterhoft et al. |
| 2012/0193098 | A1* | 8/2012 | Turner et al. ..... 166/301 |

OTHER PUBLICATIONS

Halliburton, "FracDoor® Sleeve Lets Anadarko Independently Fracture Three Zones in One Day" Offshore, 2006 (1 page).

Notification of Transmittal of the International Search Report and the Written Opinion of the International Searching Authority, or Declaration (3 pages); International Search Report (4 pages); and Written Opinion of the International Searching Authority (8 pages), mailed Sep. 6, 2010, for related international application PCT/US2010/022755.

Canadian Office Action, Canadian Application No. 2,788,553, Nov. 15, 2013, 2 pages.

Completion Solutions, Halliburton Catalog, 377 pages.

* cited by examiner

METHOD AND APPARATUS FOR SEALING AN ANNULUS OF A WELLBORE

TECHNICAL FIELD

This disclosure relates to sealing an annulus of a wellbore.

BACKGROUND

Wells, through which production, for example, oil, natural gas, hydrocarbons, and the like are withdrawn from subterranean zones under the earth's surface, are formed by drilling down to the subterranean zones from a terranean surface (e.g., on land or subsea). The wells can include seals both near the terranean surface and near the subterranean zone to control the flow of the production. When the wells are being drilled, drilling fluid (i.e., "mud") that is pumped from the terranean surface into the wellbore serves as one of the seals until the subterranean zone has been reached. Once the subterranean zone has been reached, the mud is removed and production string is lowered into a wellbore. An annulus between the production string and wellbore is thereafter sealed by a packer such that the production flows to the terranean surface through the production string.

DETAILED DESCRIPTION

Figure 1:
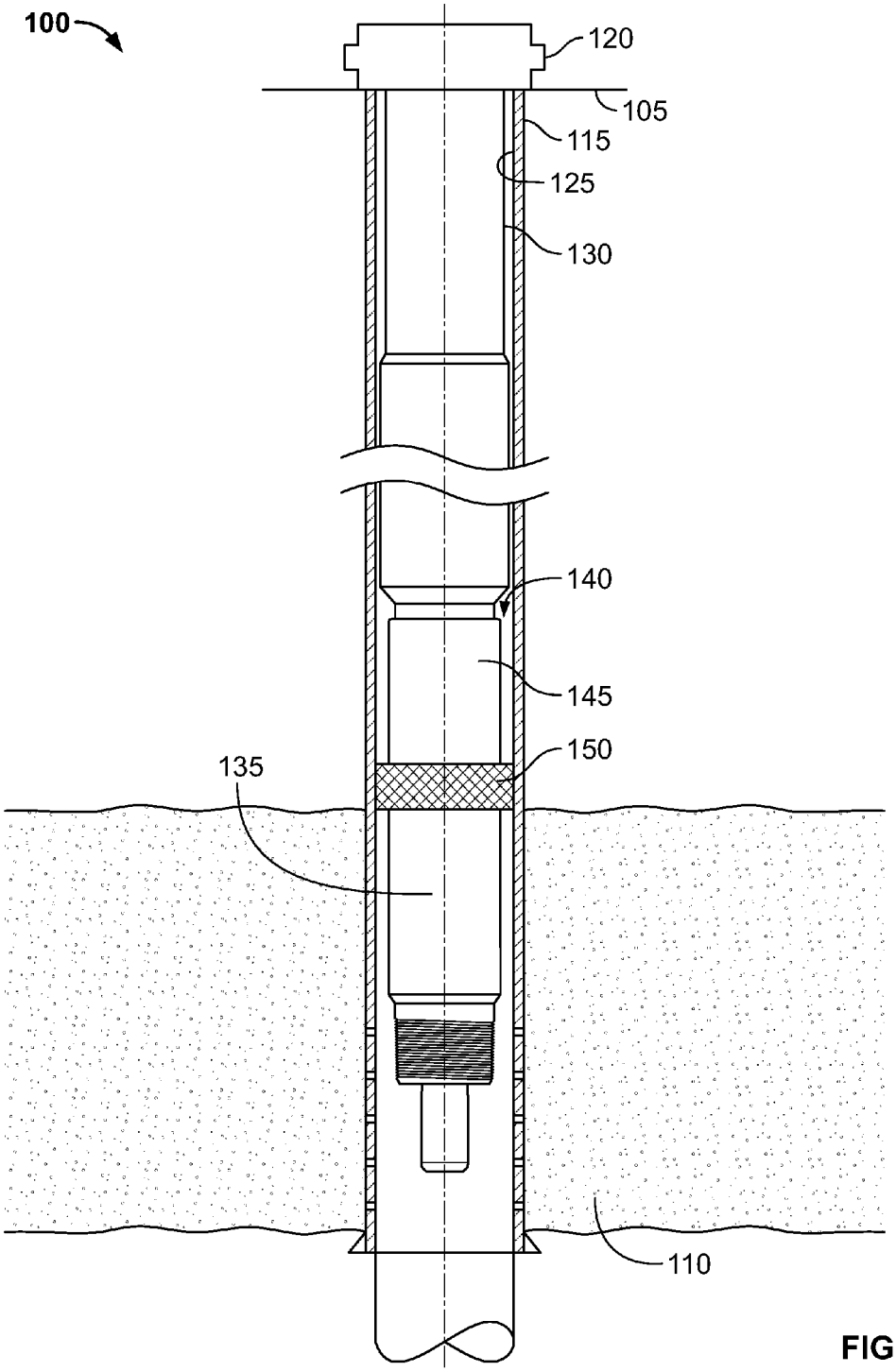
FIG. 1 is a schematic diagram showing a well to procure production from a subterranean zone.

In one general embodiment, a well system includes a production string adapted to extend from a wellhead to a subterranean zone. The production string includes one or more joints of tubing comprising a bore; a seal actuable by a specified pressure in the bore to substantially prevent fluid communication in an annulus between a first portion of a wellbore and a second portion of the wellbore, and an intervention sub comprising a body and a plurality of ports adapted to allow fluid communication between the bore and the annulus. The annulus is disposed between an exterior surface of the production string and a wellbore. The intervention sub further includes a seat adapted to receive a plug from the terranean surface and seal the bore to substantially prevent fluid communication through the ports.

In another general embodiment, a method for setting a production string in a wellbore includes running a production string into a wellbore from a terranean surface to a subterranean zone. The production string includes a bore therethrough, a packer, and an intervention sub comprising a body having a plurality of ports and a seat. The method further includes inserting a plug into the bore to land on the seat; applying a hydraulic pressure through the bore to the plug on the seat to close the ports to fluid communication between an annulus disposed between the production string and the bore; and applying a second hydraulic pressure through the bore to actuate the packer to substantially prevent fluid communication in the annulus across the packer.

In another general embodiment, a downhole tool includes a body including a bore and having a first plurality of ports therethrough; a sleeve releasably secured to the body on an interior surface of the body and having a second plurality of ports therethrough; and a seat assembly releasably secured to the sleeve on an interior surface of the sleeve. The seat assembly includes a profile engageable by a downhole tool; and a seat adapted to receive a plug from a terranean surface, where the plug is adapted to substantially prevent fluid communication through the bore when engaged with the seat.

In one aspect of one or more general embodiments, the body may include a first portion of the plurality of ports and the intervention sub may further include a sleeve including a second portion of the plurality of ports within the body, where the first and second portions of ports may allow fluid communication between the bore and the annulus when aligned.

In one aspect of one or more general embodiments, the sleeve may be adapted to be displaced when the seat receives the plug, and the first and second portions of ports may be misaligned upon displacement of the sleeve.

In one aspect of one or more general embodiments, the intervention sub may further include a seat assembly releasably secured to the sleeve on an interior surface of the sleeve, and the seat assembly may include the seat at a downhole end of the assembly.

In one aspect of one or more general embodiments, the seat assembly may further include a profile and a collet, where the profile may be adapted to be engaged by a downhole tool, and the seat assembly may be retrievable to the terranean surface through the bore by the downhole tool engaged with the profile.

In one aspect of one or more general embodiments, the collet may be adapted to be engaged by a portion of the downhole tool to expose one or more pressure equalizing ports disposed through the seat assembly to substantially equalize pressure in regions uphole and downhole of the seat. In one aspect of one or more general embodiments, the downhole tool may be a wireline tool.

In one aspect of one or more general embodiments, the plug may be adapted to receive a hydraulic pressure to seat the plug on the seat. In one aspect of one or more general embodiments, the plug may be adapted to receive a further hydraulic pressure while seated, and the plug may be adapted to transfer the further pressure to the sleeve to misalign the first and second portions of ports.

In one aspect of one or more general embodiments, the seal may be a packer adapted to actuate in response to the further hydraulic pressure. In one aspect of one or more general embodiments, the system may further include a check valve coupled to a downhole end of the intervention sub; and one or more instrument packages coupled to the check valve.

In one aspect of one or more general embodiments, running a production string into a wellbore may be a one-trip operation. In one aspect of one or more general embodiments, the wellbore may include a first fluid, and prior to applying the hydraulic pressure to the plug, a second fluid may be pumped into the wellbore to displace at least a portion of the first fluid to a terranean surface.

In one aspect of one or more general embodiments, pumping a second fluid into the wellbore to displace at least a portion of the first fluid to a terranean surface may include pumping the second fluid through the annulus; and displacing the first fluid through the ports and uphole in the bore of the production string.

In one aspect of one or more general embodiments, the intervention sub may further include a seat assembly releasably secured to the body, and a third hydraulic pressure may be applied through the bore to detach the assembly from the body.

One aspect of one or more general embodiments may further include inserting a wireline tool from the terranean surface in the bore through the production string; securing the wireline tool to the seat assembly; and retrieving the seat assembly to the terranean surface with the wireline tool.

In one aspect of one or more general embodiments, securing the wireline tool to the seat assembly may include landing the wireline tool on a profile disposed on an interior surface of the seat assembly; engaging the profile with the wireline tool; engaging at least a portion of the wireline tool with a collet of the seat assembly; adjusting the collet to expose one or more pressure equalizing ports disposed through the seat assembly; and equalizing pressure between regions in the bore uphole and downhole of the seat.

In one aspect of one or more general embodiments, the plug may be adapted to receive a first hydraulic pressure, and the sleeve may be detached from the body and urged downhole by the first hydraulic pressure to misalign the first and second plurality of ports. Fluid communication between an exterior of the body and the bore may be substantially prevented upon misalignment of the first and second plurality of ports.

In one aspect of one or more general embodiments, the plug may be adapted to receive a second hydraulic pressure, and the seat assembly may be detached from the sleeve and urged downhole by the second hydraulic pressure. The seat assembly may be adapted to be removed from the body to the terranean surface by the downhole tool engaged with the profile without removing the body or sleeve upon detachment of the assembly from the sleeve.

In one aspect of one or more general embodiments, the downhole tool may be a component of a production string adapted to extend from the terranean surface to a subterranean zone. In one aspect of one or more general embodiments, the tool may be adapted to allow a one trip operation to install the production string in a wellbore while maintaining at least two fluidic seals between the subterranean zone and the terranean surface.

Particular embodiments of the subject matter described in this specification can be implemented so as to realize one or more of the following features. For example, a downhole tool as described in the present disclosure may allow a production string to be set in a wellbore in one-trip downhole. Thus, the downhole tool may allow for the realization of more efficient (e.g., time, costs, manpower, and others) operations to set a production string. As another example, the downhole tool according to the present disclosure may allow for a full bore passage through the production string in order to, for example, produce hydrocarbons from a subterranean zone once the tool is removed to the surface. Further, the downhole tool may allow for removal to the surface by a wireline tool. The downhole tool may also allow a packer (e.g., a production packer) to be actuated (hydraulically or otherwise) in a one-trip production string setting operation. Additionally, the downhole tool may allow for more complete well control by providing for a continuous mud seal during insertion of the production string into the wellbore.

Particular embodiments of the subject matter described in this specification can be implemented so as to also realize one or more of the following features. For example, a downhole tool as described in the present disclosure may allow for back pressure control during fluid circulation to prevent inflow from a subterranean zone. Further, debris left on plug due to multiple entries through a seal bore may be decreased. The downhole tool may also allow for a packer to be set in clean completion fluid rather than mud. The tool may also allow for a reduced number of trips into a wellbore to remove a plug and/or data recorders. In addition, the downhole tool may allow for retrieval of a valve assembly therein even in an overbalanced condition through a pressure equalizing mechanism. Further, the downhole tool may allow for a production string to be landed at the terranean surface (e.g., at a wellhead) when mud is being evacuated.

Wells include production strings through which production of hydrocarbons (e.g., oil, natural gas, and others) are pumped and brought to the surface. Generally, a string refers to one or more pieces of tubing and other devices (e.g., tools) connected end-to-end. A production string spans from a terranean surface to a region under ground where the production is found. Often the production string can span a few thousand feet (for vertical bores) and even a mile (for horizontal bores). Some methods to install the production string involve multiple trips through the wellbore, a portion of the production string being installed during each trip. Using the techniques described here, an entire span of the production string (i.e., the complete production string) can be installed in a single trip negating the need for multiple trips to install the production string in portions.

FIG. 1 is a schematic diagram showing a well 100 to procure production from a subterranean zone. The well 100 spans a distance extending from a terranean surface 105 to a subterranean zone 110, which is a region from which production, for example, oil, natural gas, and the like, is captured. The subterranean zone 110 can be a single formation, a portion of a formation, or multiple formations. The well 100 includes a wellbore 115 that extends from the terranean surface 105 to the subterranean zone 110. Although FIG. 1 shows the wellbore 115 as having a vertical orientation, wellbore 115 can be deviated from the vertical orientation and can be, for example, a horizontal wellbore, a slanted wellbore, a multi-lateral wellbore, and the like. A multi-lateral wellbore can include multiple horizontal wellbores that deviate from a vertical wellbore.

The well 100 includes a well head 120 at the top of the well 100; the well head 120 is positioned at the terranean surface 105. In some implementations, the well 100 includes a casing 125 attached to the well head 120 and extending downhole from the well head 120, i.e., in a direction from the terranean surface 105 toward the subterranean zone 110. In some implementations, the casing 125 can extend from a casing hanger at the well head 120 down through the wellbore 115, such that an annulus 140 is formed between an outer surface of the casing 125 and an inner surface of the wellbore 115. The casing 125 can be cemented in place. A portion of the casing 125 in the subterranean zone 110 can include perforations on the outer surface to allow fluid communication between the wellbore 115 and the subterranean zone 110. In alternative implementations, the well 100 does not include a casing. Thus, reference to a wall or surface of the wellbore 15 may include reference to the casing 125 or an open hole completion (e.g., wellbore without a casing).

Once the wellbore 115 is formed, a production string 130 can be run inside the wellbore 115. Typically, the production string 130 is a string through which the production in the subterranean zone 110, for example, oil, gas, other hydrocarbon, flows up to the terranean surface 105. The production string 130 extends from the well head 120 through the wellbore 115 into the subterranean zone 110, thereby forming an annulus 140 between the inner surface of the casing 125 and an outer surface of the production string 130. Additionally, the production string 130 includes perforations 135 (or other apertures) to allow fluid communication between the subterranean zone 110 and the interior of the production string 130.

The production string 130 includes a production packer 145. The production packer 145 includes a seal 150, for example, a circumferential seal, that seals the annulus 140 between the production string 130 and the casing 125. The production packer 145 can be actuated to seal or not seal the annulus 130 such that the production packer 145 controls fluid flow between the portion of the annulus 130 below the packer 145 and the portion above the packer 145. The seal 150 can be actuated mechanically or hydraulically. In some implementations, the production packer 145 is positioned adjacent to, for example, at or immediately above, the subterranean zone 110, as shown in FIG. 1. Although a single packer 145 and zone 110 are illustrated, the well 100 may access multiple subterranean zones and a unique production packer can be positioned at or above each of the accessed subterranean zones by repeating the methods for positioning the production packer 145 above the subterranean zone 110. In such scenarios, each production packer may include a circumferential seal that seals against the interior wall of the casing and prevents co-mingling of fluids between multiple subterranean zones in the annulus 140 or portions of the production string 130.

The production string 130 described above is positioned within the casing 125 after the wellbore 115 is drilled. The wellbore 115 is drilled using a drill bit that is attached to an end of a drill string. Mud, piped through the drill string, serves to remove the material from the wellbore 115 and serves the additional purpose of sealing the subterranean zone 110 from the terranean surface 105 so that production does not blow out of the wellbore 115. A seal (e.g., a blow out seal) at the surface of the well 100 serves as an additional seal to prevent hydrocarbon fluid from flowing out of the wellbore 115. As the wellbore 115 is drilled to the subterranean zone 110, the casing 125 is lowered into the wellbore 115 and secured. At this stage, the wellbore 115 is filled with mud. To access the production in the subterranean zone 110, the production string 130 is lowered to the subterranean zone 110, secured, and sealed to the well head 120 using, for example, a tubing hanger. In some implementations, the tubing hanger has a female profile in the well head 120 that mates to a male profile in the tubing and supports the tubing in the well head 120.

The mud within the wellbore 115 can be removed from the casing 125 by flowing water down through the annulus 140 and returning to the surface 105 through the production string 130. The water, in some scenarios, is mixed with a corrosion inhibitor, and flows through the annulus 140, displacing the mud, and causes the mud to flow to the terranean surface 105 through the production string 130. Alternatively, the water (or other fluid) may be pumped down through the production string 130 and up to the surface 105 through the annulus 140. At this stage, to access the production in the subterranean zone 110, the portion of the production string 130 near the subterranean zone 110 can be set by sealing the annulus 140.

Prior to activating the seal 150 surrounding the production packer 145, the portion of the wellbore 115 within the subterranean zone 110 is isolated from the rest of the wellbore 115. This enables applying hydraulic pressure to the seal 150 without pressurizing the subterranean zone 110. The ability to isolate the portion of the wellbore 115 within the subterranean zone enables positioning the entire production string 130 in one trip within the casing 125. In some implementations, a downhole tool 200, described in detail with reference to FIGS. 2A-2E, is attached to the production string 130 to perform the aforementioned isolation. Once the portion of the wellbore 115 within the subterranean zone 110 has been isolated, the seal 150 is pressure-activated from the terranean surface 105 to seal the annulus 140. At this stage, the production string 130 is completely set, i.e., engaged at the well head 120 by the tubing hanger and engaged at the production packer 145 by the circumferential seal 150. In certain instances, portions of the downhole tool 200 can be removed from the production string 130 using, for example, a wire line fishing tool lowered into the production string 130 from the terranean surface 105, to open the full bore of the production string 130 for production to flow from the subterranean zone 110 to the terranean surface 105. An example of the downhole tool 200 is described with reference to FIGS. 2A-2E.

FIGS. 2A-2E are schematic diagrams of a cross-section of one embodiment of a downhole tool 200 for isolating portions of the wellbore 115. In the illustrated embodiment, the tool 200 may be an intervention subassembly (or intervention sub). The downhole tool 200 is arranged in the production string 130 and proximate the casing 125 such that a longitudinal axis 203 of a housing 210 of the tool is substantially parallel to, for example, co-linear with, an axis of the production string 130. The housing 210 extends from an upper (i.e., uphole) end of the tool 200 (shown in FIG. 2A) to a lower (i.e., downhole) end of the tool 200 (shown in FIG. 2E). FIGS. 2A-2E show portions of the tool 200 such that a sequence of the figures corresponds to an arrangement of the portions of the tool 200 from an uphole end, i.e., toward the terranean surface 105, toward the downhole end, i.e., toward the subterranean zone 110.

Figure 2A:
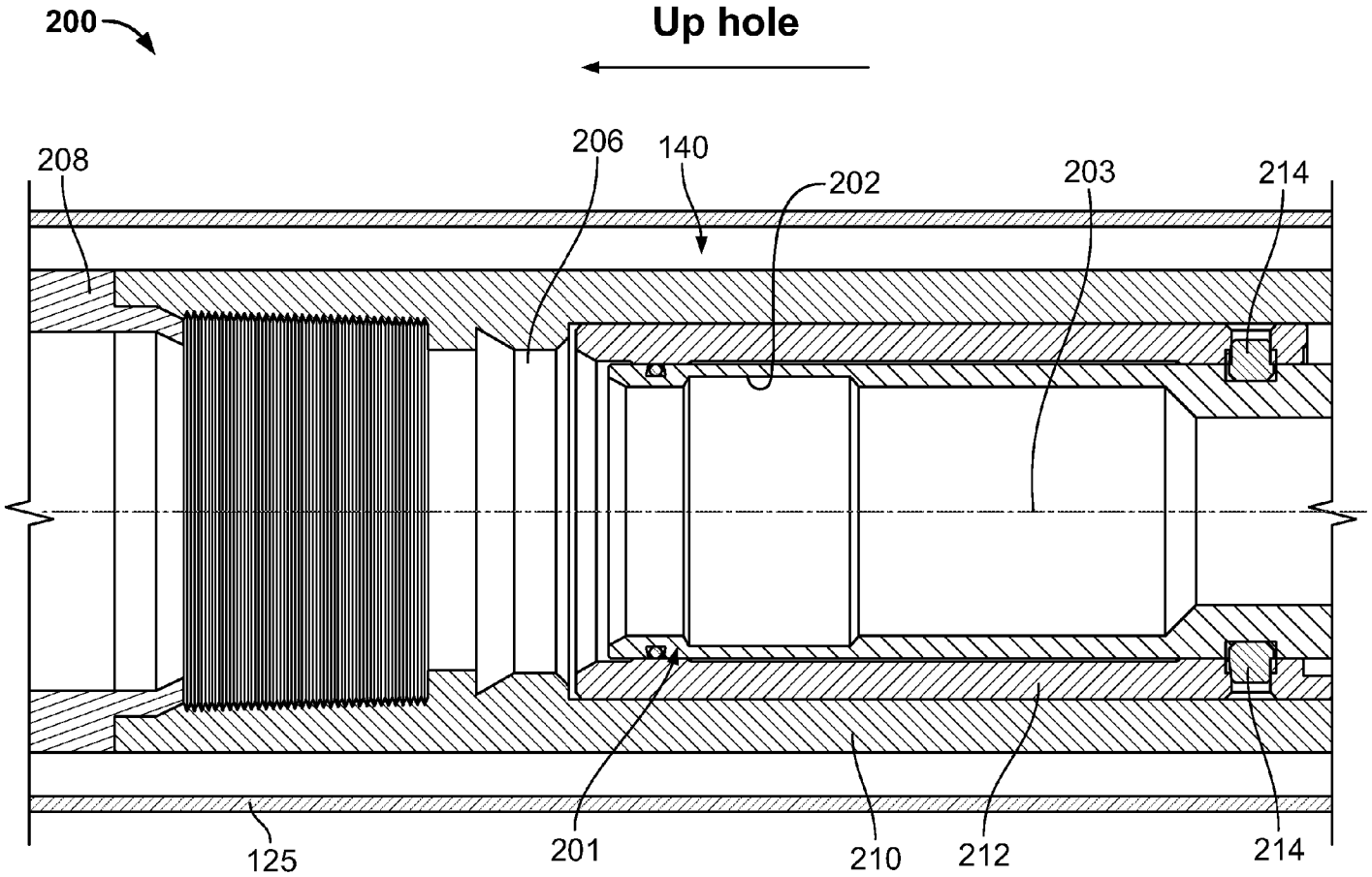
FIGS. 2A-2E are schematic diagrams of a cross-section of one embodiment of a downhole tool for isolating portions of the wellbore.

As shown in FIG. 2A, the housing 210 includes a threaded fish neck 206 that is attached (threadingly or otherwise) to a string 208 positioned adjacent to the housing 210 at the uphole end of the tool 200. As described later, the tool 200 can be removed by lowering a wire line fishing tool into the housing 210, capturing, and raising the assembly 201. The housing 210 includes multiple ports 230 (shown in FIG. 2C) downhole from the threaded fish neck 206. The tool 200 additionally includes a sleeve 212 positioned within the housing 210.

Arranged in the housing 210 proximate an interior surface of the sleeve 212 is a valve assembly 201. At a high level, the valve assembly 201 includes a valve seat 226 that can receive a plug 224, and may allow for the bore of the tool 200 to be substantially sealed to fluid communication therethrough above the seat 226. In certain instances, this may allow for the packer 145 to be actuated, thereby sealing the annulus 140 and substantially preventing fluid communication across the seal 150 of the packer 145. The valve assembly 201 may also be removed from the tool 200 to allow full bore (e.g., substantially equal to an inner diameter of the sleeve 212) production through the tool 200 and production string 130. Thus, the valve assembly 201 may, at least in part, provide for the production string 130 to be installed in a one-trip operation rather than in multiple downhole operations.

The valve assembly 201, as illustrated, extends from the fish neck 206 downhole through the bore of the tool 200 and includes a female profile 202 disposed on an interior surface of the assembly 201. As noted above, in some implementations, a fishing tool (not shown) may be inserted into the wellbore 115 and through the bore of the tool 200 and engage the female profile 202 in order to retrieve the valve assembly 201 of the tool 200 to the terranean surface.

The tool 200 also includes shear pins 214 disposed between the sleeve 212 and the valve assembly 201. Shear pins 214, as illustrated, couple the sleeve 212 and the valve assembly 201 and, once sheared (e.g., by hydraulic pressure applied through the bore of the tool 200), allow the assembly 201 to be urged downhole. In some instances, the pins 214 are sheared so that the assembly 201 may be removed from the tool 200.

Figure 2B:
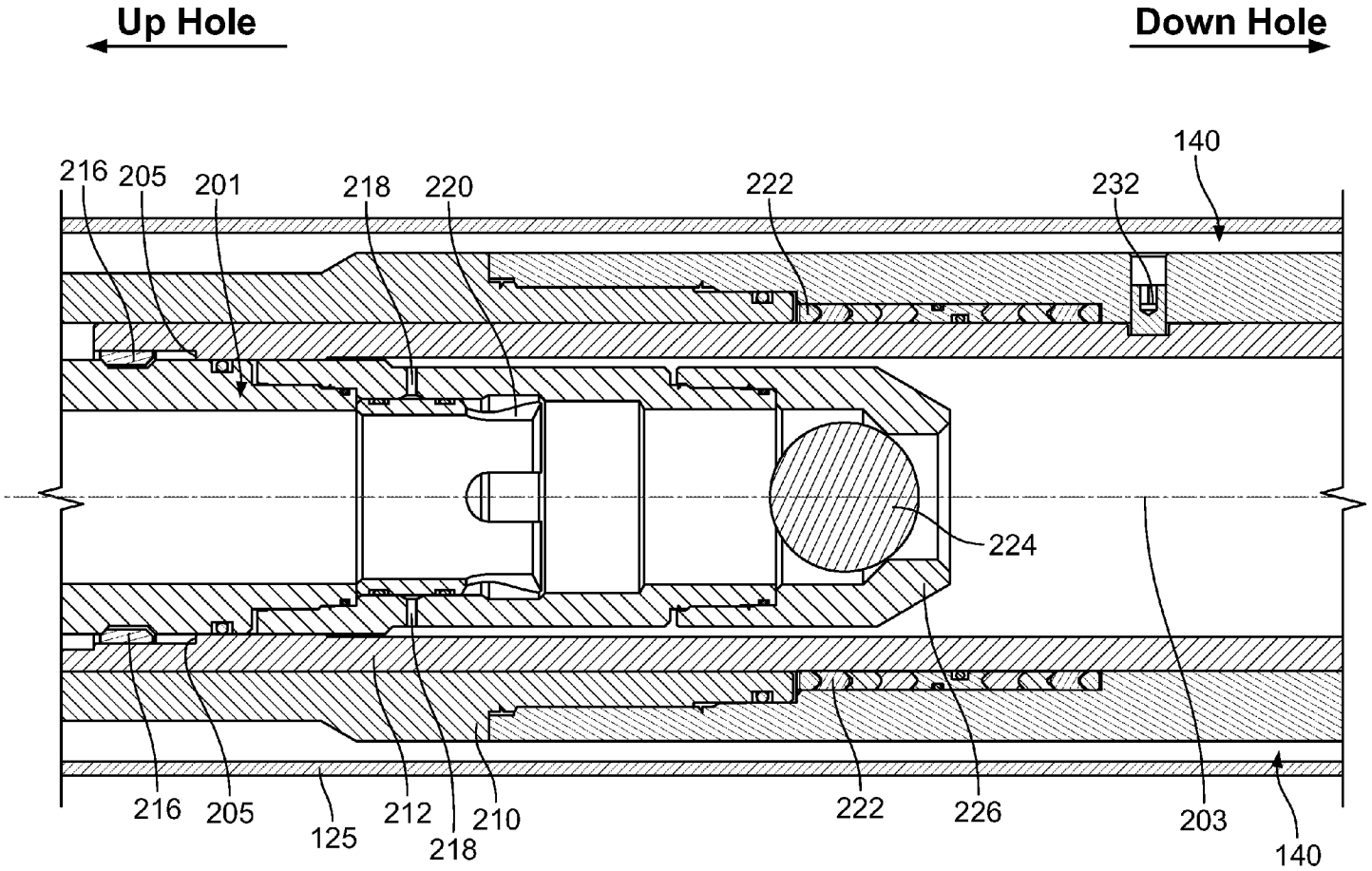

Turning to FIG. 2B, the valve assembly 201 continues to the valve seat 226. As illustrated, the assembly 201 may include multiple segments connected (threadingly or otherwise) or, alternatively, may be a single piece component. The valve assembly 201 also includes one or more pressure equalizing ports 218 therethrough. As explained more fully later, the ports 218, once uncovered by operation of the fishing tool used to retrieve the assembly 201, may allow for pressure equalization between a region uphole of the valve seat 226 (i.e., adjacent the plug 224) and a region downhole of the seat 226. In some instances, such equalization may occur prior to retrieval of the assembly 201 from the tool 200.

Downhole from the shear pins 214, the tool 200 includes a disappearing no-go ring 216 that is disposed circumferentially between the valve assembly 201 and the sleeve 212. In some implementations, the ring 216 is biased radially outward and is engaged in a profile on the assembly 201. Further, the ring 216 is on a reduced diameter portion inside the sleeve 212. In the illustrated embodiment, the ring 216 may substantially prevent downhole movement of the assembly 201 upon application of hydraulic pressure on the assembly 201 through the bore of the tool 200. As illustrated, the ring 216 is proximate to a shoulder 205 of the sleeve 212.

As illustrated in FIG. 2B, the valve assembly 201 includes a collet 220 disposed on the interior surface of the assembly 201 that grips a profile on the interior of the sleeve 212. The collet 220 operates to open the pressure equalizing ports 218. The collet 220, in some implementations, may allow for the assembly 201 to be retrieved by the fishing tool. For example, the fishing tool may engage the female profile 202 while a nose of the fishing tool pushes the collet sleeve downward and snaps the collets 220 off the profile. This may allow for the assembly 201 to be further urged downhole, thereby exposing the pressure equalizing ports 218 to allow communication of pressure between the regions uphole and downhole of the valve seat 226. This may enable the assembly 201, which would have otherwise been locked in place due to pressure, to be pulled to the terranean surface 105.

As further illustrated in FIG. 2B, the tool 200 may include seals 222. Typically, the seals 222 may substantially prevent fluid communication between the seals 222, out of the ports 228 when such ports are misaligned with the ports 230 (as explained below), or other instances of operation. The seals 222 may also serve to cut off communication between the portion of the tool 200 below the valve seat 226 and the portion above. In the illustrated embodiment, the seals 222 may be chevron shaped and made of, for example, Teflon/Ryton®, or other sealing material.

The valve seat 226 may receive a plug 224 therein. Although FIG. 2B shows a ball seated in the valve seat 226 as a seal, it will be appreciated that any plug can be positioned in a corresponding valve seat 226 to serve as the seal. Typically, the plug 224 may be dropped (e.g., by gravity, hydraulic pressure, or otherwise) from the surface 105 and land in the valve seat 226. Upon the seat 226, the plug 224 may, at least in part, substantially prevent fluid communication through the bore of the tool 200. Further, as described below, the plug 224 in its seat 226 may allow for actuation of the packer 145. For example, in some implementations, the tool 200 is lowered into the production string 130 and secured in place such that the upper end of the tool 200 is immediately adjacent to the production packer 145.

The tool 200 includes shear pins 232 disposed between the sleeve 212 and the housing 210. Upon pressure applied to the pins 232 (e.g., hydraulic, mechanical, or otherwise), the sleeve 212 may be urged downward until it abuts a shoulder 243 of the housing 210 (shown in FIG. 2D). In certain instances, this may allow for the ports 228 and 230 to be misaligned, thereby preventing fluid communication therethrough.

Figure 2C:
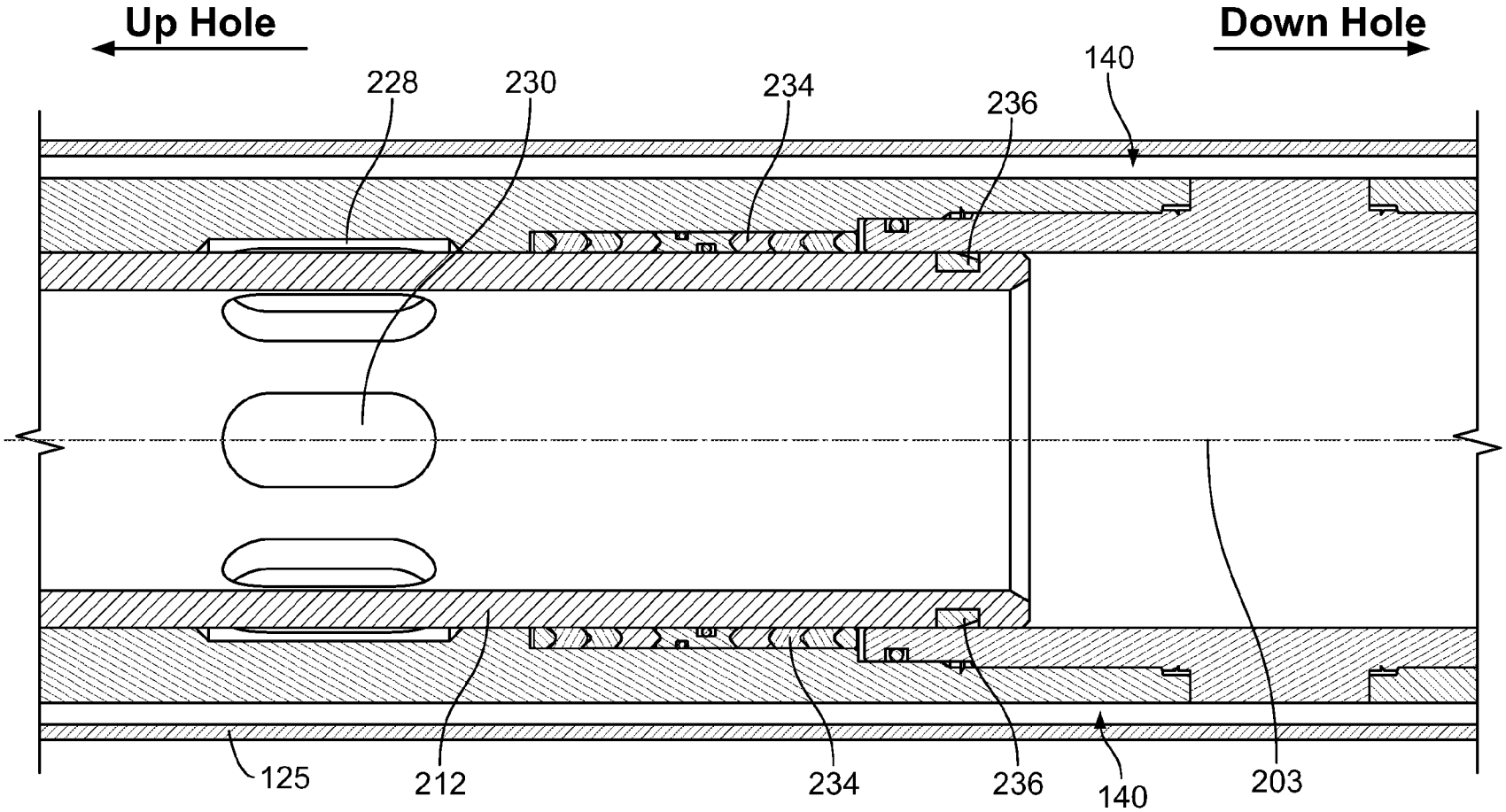

Turning to FIG. 2C, the ports 228 formed in the housing 210 and ports 230 formed in the sleeve 212 are illustrated. When the multiple ports 230 formed in the sleeve 212 are aligned with the multiple ports 228 formed in the housing 210, fluid communication may occur between the region inside and outside the tool 200. Specifically, for example, when the ports are aligned, communication occurs between the region inside the tool 200 and the annulus 140. In some implementations, a region formed between the housing 210 and the sleeve 212 includes seals 234 (FIG. 2C) that can be chevron shaped, for example. Upon misalignment of the ports 230 and the ports 228 (e.g., when the sleeve 212 is slid downhole away from the valve seat 226 to abut against the shoulder 243), fluid communication between the bore of the tool 200 and the annulus 140 may be substantially prevented.

In some implementations, the tool 200 includes a lock ring 236 positioned downhole from the seals 234 in a region between the sleeve 212 and the housing 210. The lock ring 236 can be biased radially outward such that when the sleeve 212 is urged downward, the ring 236 may lock the sleeve 212 in place, thereby blocking the passage of the fluid between the tool 200 and the annulus 140. In some implementations, the leading edge of the lock ring 236 can be chamfered.

Figure 2D:
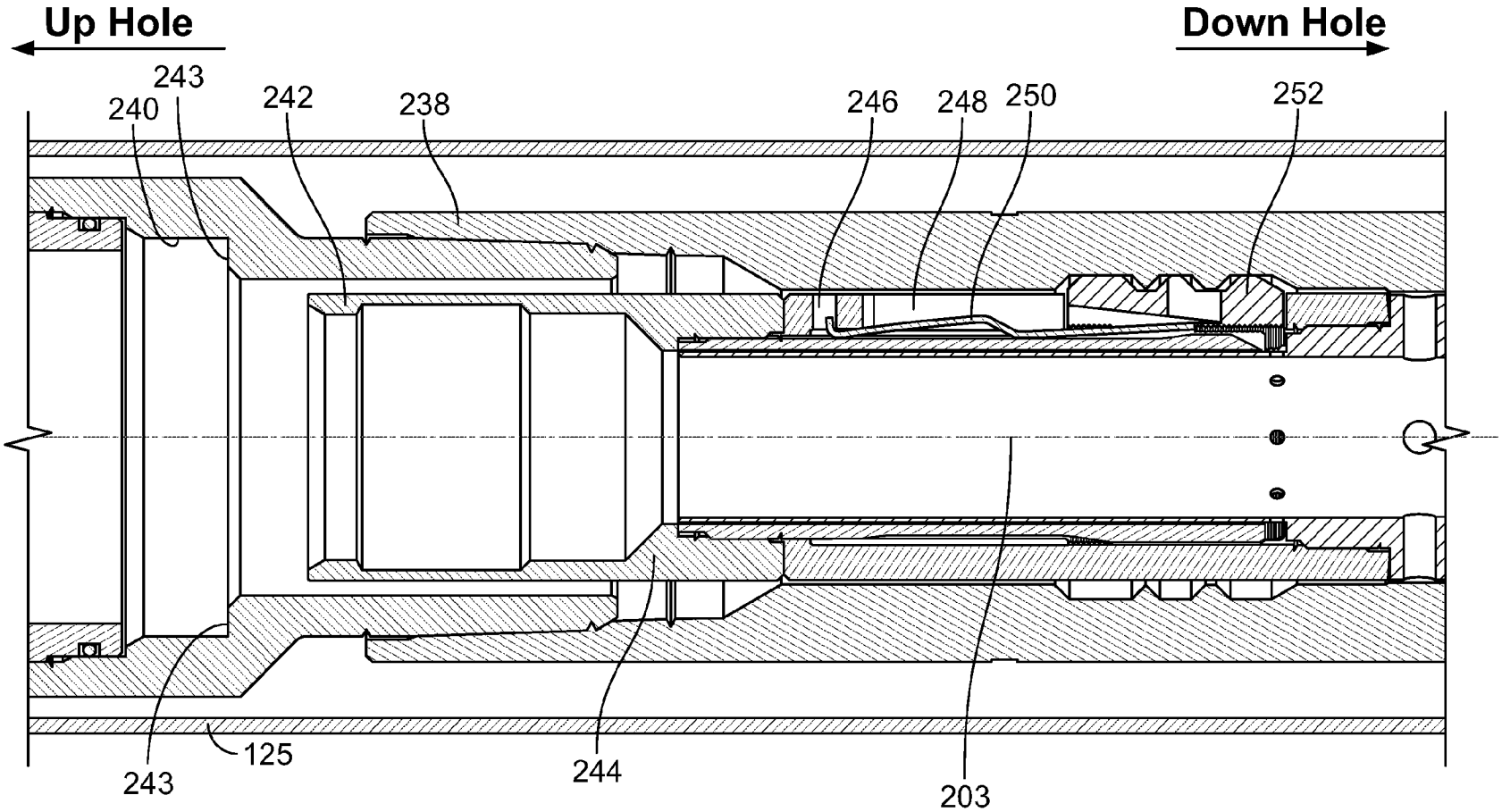

Turning to FIG. 2D, an end of the tool 200 is attached to a landing nipple 238 downhole of the shoulder 243 on which the sleeve 212 abuts in the downhole position (i.e., when the ports 230 are misaligned with the ports 228). The landing nipple 238 includes a lock mandrel 244 to attach the landing nipple 238 to the tool 202. As illustrated, the lock mandrel 244 includes a fish neck 242. Downhole from the fish neck 242, the landing nipple 238 includes an expander sleeve 246, a key retainer 248, a spring 250, and keys 252. Alternatively, in other embodiments, additional or fewer components may be attached to the tool 200.

Figure 2E:
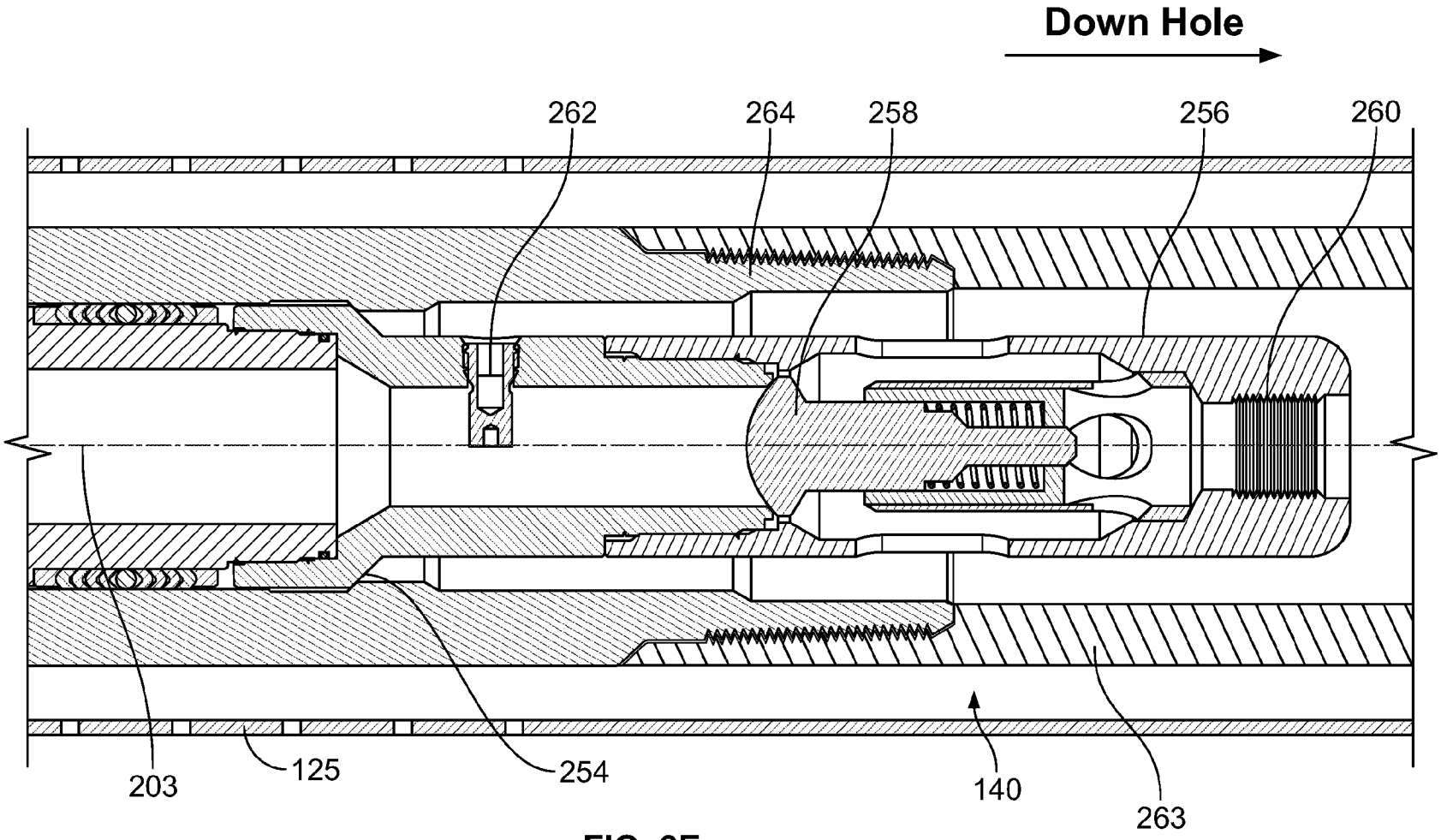

As shown in FIG. 2E, downhole from the keys 252 is a check valve 256 that is supported at the shoulder 254. The expander sleeve 246, the key retainer 248, and the spring 250 serve as a lock that retains the plug 224 in the valve seat 226. Specifically, the lock may help prevent the plug 224 from floating upward if the pressure in the region below the plug 224 increases. The key 252 can be a multi-part key arranged circumferentially. In some implementations, the key 252 can include circumferential projections. The key retainer 248 can include slots into which the projections extend. In this manner, the circumferential projections abut the key retainer and prevent the key 252 from falling.

The check valve 256 is landed in the interior of the landing nipple 238. The check valve 256 is biased to allow flow of fluid downhole but prevent flow uphole. The check valve 256 includes a region 258 that releases trapped pressure from above by causing a spring in the check valve 256 to deform. The check valve 256 further includes a threaded bottom 260 to which instruments, for example, pressure and temperature recorders, can be attached. The production string 130 further includes a plug 262, for example, a shear plug in the lock or the check valve 256 that can be sheared off in a contingency operation to allow communication between the interior and the exterior of the bore. A string 263 (e.g., tubing, other tools, or otherwise) can be attached to the threaded downhole end 264 of the production string.

In operation, the production string 130 is run into the wellbore 115, for example, through the casing 125. The uphole end of the production string 130 is landed in the well head 120, for example, at the tubing hanger. The production string 130 includes the tool 200 described previously. Fluid (e.g., water with a corrosion inhibitor or other fluid) is flowed down through the annulus 140 and back up through the ports in the wellbore 115. The fluid flows past the tool 200, displaces the mud into the aligned ports 228 and 230 and flows up through the wellbore 115. Once all or substantially all of the mud has been displaced, the production packer 145 can be set. To do so, the plug 224 is released (e.g., dropped by gravity or pumped hydraulically) into the production string 130 and comes to rest in contact with the valve seat 226, thereby sealing the region below the valve seat 226 from the region above the valve seat 226.

Pressure is then applied (e.g., hydraulically) from the terranean surface 105 causing the pins 232 to shear, thereby allowing the sleeve 212 (and also valve assembly 201) to move downhole and abut the shoulder 243 of the housing 210, thereby misaligning the ports 228 and 230. Once the sleeve 212 abuts the shoulder 243, the lock ring 236 may snap into profile 240 in order to prevent uphole movement of the sleeve 212, thereby substantially locking the ports 228 and 230 into misalignment.

This hydraulic pressure, or, in some instances another application of hydraulic pressure or other actuation technique, may also actuate the packer 145. In response to the pressure, the gripping members inside the packer 145 grip and seal on to the interior of the casing 125 thereby sealing the annulus 140.

After application of the hydraulic pressure to misalign the ports 228 and 230 and actuation of the packer 145, another application of hydraulic pressure (e.g., a greater application of pressure) may be applied to the tool 200 through the bore. This secondary application may shear the shear pins 214, thereby allowing the valve assembly 201 to be urged downhole until the no-go ring 216 abuts the shoulder 205 on the sleeve 212. At this instant, the assembly 201 may be retrieved from the tool 200 with a wire line fishing tool, for example, as described below.

The wire line tool can be dropped into the production string 130 and landed in the fish neck profile 202 at the uphole end of the tool 200. The wire line tool can be actuated to engage the profile 202 and pull the assembly 201 out of the tool 200 (and thus out of the production string 130). Further, the nose of the fishing tool may contact the collet 220 and flex the collet 220 inward to snap into the profile, thereby exposing the ports 218 to equalize the pressure uphole and downhole of the seat 226. The valve assembly 201 may thus be removed from the tool 200, providing a full bore that communicates down to the production string 130 to withdraw production from the subterranean zone 110.

Figure 3:
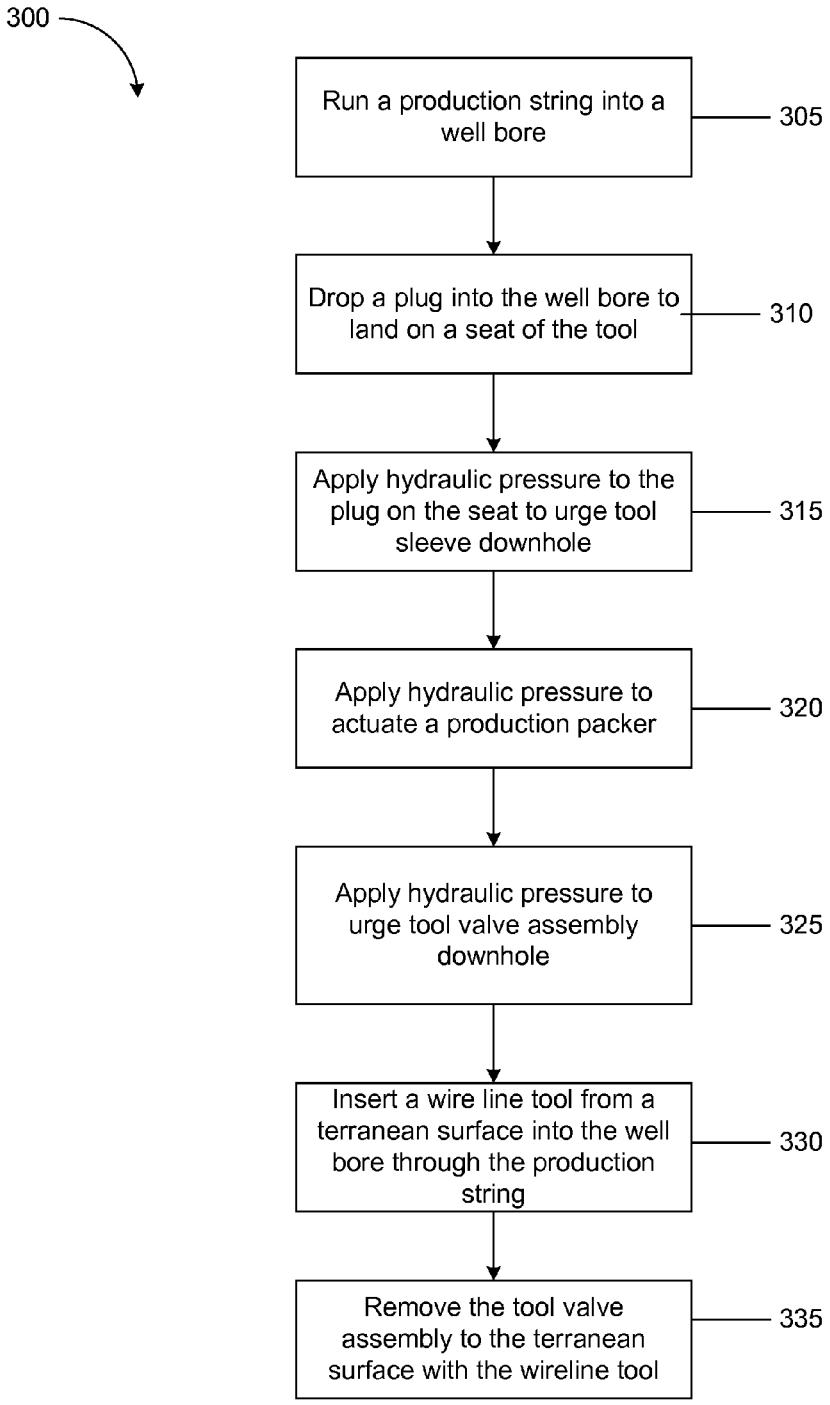
FIG. 3 is a flow chart of an example process for setting a production tubing.

FIG. 3 is a flow chart of an example process 300 for setting a production tubing. In some embodiments, process 300 may be used to set a production tubing in one-trip downhole, thereby eliminating or substantially eliminating multiple trips into the wellbore. The process 300 runs a production string into a wellbore (step 305). For example, the production string 130 is run into the wellbore 115. The production string 130 includes a bore and an intervention sub, for example, the tool 200, that includes a housing, for example, housing 210 having multiple ports 228 and a seal, for example, the valve seat 226.

The process 300 drops a plug into the wellbore to land on the seat (step 310). For example, a plug 224 is released into the production string 130 at the terranean surface 105. The plug 224 lands in the valve seat 226 or, alternatively, can be pressured through the production string 130 to land in the seat 226.

The process 300 applies a hydraulic pressure to the plug 224 on the seat 226 to close the ports to fluid communication (step 310). For example, pressure from the terranean surface 105 ensures that the plug 224 is securely positioned in the seat 226 and urges a sleeve within the tool 200 to move downward to seal fluid communication between the annulus and an interior of the tool 200.

The process 300 applies a second hydraulic pressure to actuate a production packer (step 320). For example, pressure from the terranean surface 105 activates a production packer 145 in the annulus between the production string 130 and the bore 115 such that the circumferential seal 150 in the packer 145 is activated, thereby sealing the annulus 140. Alternatively, the hydraulic pressure applied to move the sleeve 212 may actuate the packer as well.

The process 300 may then apply another hydraulic pressure on the tool to urge a valve assembly interior to the tool housing 210 downhole. For example, the pressure may shear the shear pins 214 thereby allowing the assembly 201 to be urged downhole until the no-go ring 216 to abut the shoulder 205 of the sleeve 212.

The process 300 may then insert a wire line tool from a terranean surface into the wellbore through the production string (step 330). For example, the wire line tool is inserted from the terranean surface 105 into the wellbore 115 through the production string 130.

The process removes the valve assembly 201 of the downhole tool 200 to the terranean surface with the wireline tool (step 335). For example, the wire line tool locks the assembly 201. The wire line tool is then raised to the terranean surface 105 thereby removing the assembly 201 from the production string 130. In this manner, the production string 130 may be installed in a one-trip operation with a full bore for production of hydrocarbons therethrough.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

For example, although the valve assembly 201 is described as retrievable by a wireline fishing tool, the valve assembly 201 may also be retrieved via coiled tubing. Further, check valve 256, as well as any sensors attached (threadingly or otherwise) thereto, such as pressure and/or temperature recorders, may be retrieved via wireline and/or coiled tubing techniques.

As another example, in some implementations, the production string 130 can include multiple components. For example, the production string 130 can include a re-entry guide which is a mechanism connected to an end of the production string 130 to facilitate passing the string 130 through the casing 125. In some implementations, the re-entry guide can include one of a conical end, a ball nose end, or a cylindrical mechanism with ball nose edges that prevent the string 130 from becoming tangled with the inner surface of the casing 125. The production string 130 can include a pup joint which is a short joint of tubing, for example, two feet long, connected to the top of the re-entry guide. The production string 130 can include a landing nipple, which is a piece of tubing that has a specified bore to permit sealing.

One or more pup joints, each of which is, for example, ten feet long, are attached to the device. Landing nipples are attached to the pup joints. Each landing nipple can have a profile that allows certain tools to engage with the pup joint.

The production packer 145, positioned around the production string 130, can include a hydraulically actuated mechanism. In some scenarios, the hydraulic mechanism of the production packer 145 can be actuated by applying a specified pressure on the interior of the packer 145. When the pressure is applied, internal passages in the packer 145 can actuate, an internal piston can move within the passages, and flips can be actuated to grip the interior of the casing 125. Flips are wedges with serrations machined into the exterior which extend radially outward to grip the interior of the casing 125 by plastically deforming the casing. In alternative implementations, the packer 145 can seal against the casing using dogs or collets, which are blocks of metal that extend radially outward and fit into a recess in the casing 125 called a profile.

The production string 130 can additionally include a landing nipple attached to the packer 145. The nipple can have a valve or a sensor that can be lowered into the bore 115. The valve or sensor can be latched onto a profile in the landing nipple. The production string 130 can also be attached to a safety valve that can be actuated to close down the well as needed. In some scenarios, the safety valve can remain open as long as a signal, for example, a hydraulic signal, is received from the terranean surface 105, and can shut when the signal is no longer received.

Similarly, while operations or processes are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments. For example, more or less steps described in process 300 may be performed. In addition, the described steps of process 300 may be performed in orders different than those described herein.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A well system comprising:

a production string adapted to extend from a wellhead to a subterranean zone, the production string comprising:

one or more joints of tubing comprising a bore;

a seal actuable by a specified pressure in the bore to substantially prevent fluid communication in an annulus between a first portion of a wellbore and a second portion of the wellbore, the annulus disposed between an exterior surface of the production string and a wellbore; and an intervention sub comprising:

a body comprising a first portion of a plurality of ports;

a sleeve comprising a second portion of the plurality of ports, the first and second portions of the plurality of ports allowing fluid communication between the bore and the annulus when aligned; and a seat assembly releasably secured to the sleeve, the seat assembly comprising a collet and a seat, the seat adapted to receive a plug from the terranean surface and seal the bore to substantially prevent fluid communication through the ports and a profile adapted to be engaged by a downhole tool, the seat assembly retrievable to the terranean surface through the bore by the downhole tool engaged with the profile, the collet engagable by a portion of the downhole tool to expose one or more pressure equalizing ports disposed through the seat assembly to substantially equalize pressure in regions uphole and downhole of the seat.

2. The well system of claim 1, wherein the sleeve is adapted to be displaced when the seat receives the plug, the first and second portions of ports misaligned upon displacement of the sleeve.

3. The well system of claim 2, wherein the seat assembly is releasably secured to the sleeve on an interior surface of the sleeve, and the seat assembly comprises the seat at a downhole end of the assembly.

4. The well system of claim 1, wherein the plug is adapted to receive a hydraulic pressure to seat the plug on the seat.

5. The well system of claim 4, wherein the plug is adapted to receive a further hydraulic pressure while seated, the plug adapted to transfer the further pressure to the sleeve to misalign the first and second portions of ports.

6. The well system of claim 5, wherein the seal comprises a packer adapted to actuate in response to the further hydraulic pressure.

7. The well system of claim 1, further comprising:

a check valve coupled to a downhole end of the intervention sub; and one or more instrument packages coupled to the check valve.

8. The well system of claim 1, wherein the downhole tool is a wireline tool.

9. A method for setting a production string in a wellbore comprising:

running a production string into a wellbore from a terranean surface to a subterranean zone, the production string comprising a bore therethrough, a packer, and an intervention sub comprising a body having a plurality of ports, a seat and a seat assembly releasably secured to the body;

inserting a plug into the bore to land on the seat;

applying a hydraulic pressure through the bore to the plug on the seat to close the ports to fluid communication between an annulus disposed between the production string and the bore;

applying a second hydraulic pressure through the bore to actuate the packer to substantially prevent fluid communication in the annulus across the packer;

applying a third hydraulic pressure through the bore to detach the seat assembly from the body;

inserting a downhole tool from the terranean surface in the bore through the production string;

securing the downhole tool to the seat assembly, the securing comprising:

landing the downhole tool on a profile disposed on an interior surface of the seat assembly;

engaging the profile with the downhole tool;

engaging at least a portion of the downhole tool with a collet of the seat assembly;

adjusting the collet to expose one or more pressure equalizing ports disposed through the seat assembly; and equalizing pressure between regions in the bore uphole and downhole of the seat; and retrieving the seat assembly to the terranean surface through the bore with the downhole tool.

10. The method of claim 9, wherein running a production string into a wellbore comprises a one-trip operation.

11. The method of claim 9, the wellbore comprising a first fluid, the method further comprising, prior to applying the hydraulic pressure to the plug, pumping a second fluid into the wellbore to displace at least a portion of the first fluid to a terranean surface.

12. The method of claim 11, wherein pumping a second fluid into the wellbore to displace at least a portion of the first fluid to a terranean surface comprises:

pumping the second fluid through the annulus; and displacing the first fluid through the ports and uphole in the bore of the production string.

13. The method of claim 9, wherein the downhole tool comprises a wireline tool.

14. A downhole tool comprising:

a body comprising a bore and having a first plurality of ports therethrough;

a sleeve releasably secured to the body on an interior surface of the body and having a second plurality of ports therethrough; and a seat assembly releasably secured to the sleeve on an interior surface of the sleeve, the seat assembly comprising:

a profile engageable by a wireline tool;

a collet; and a seat positioned at a downhole end of the assembly and adapted to receive a plug from a terranean surface, the plug adapted to substantially prevent fluid communication through the bore, and to displace the sleeve to misalign the first and second plurality of ports, when engaged with the seat, the seat assembly adapted to be removed from the body to the terranean surface by the wireline tool engaged with the profile without removing the body or sleeve upon detachment of the assembly from the sleeve, the collet adapted to be engaged by a portion of the wireline tool to expose one or more pressure equalizing ports disposed through the seat assembly to substantially equalize pressure in regions uphole and downhole of the seat.

15. The downhole tool of claim 14, wherein the plug is adapted to receive a first hydraulic pressure to urge the sleeve downhole to misalign the first and second plurality of ports, wherein fluid communication between an exterior of the body and the bore is substantially prevented upon misalignment of the first and second plurality of ports.

16. The downhole tool of claim 14, wherein the plug is adapted to receive a second hydraulic pressure, the seat assembly detached from the sleeve and urged downhole by the second hydraulic pressure.

17. The downhole tool of claim 14, wherein the tool comprises a component of a production string adapted to extend from the terranean surface to a subterranean zone.

18. The downhole tool of claim 17, wherein the tool is adapted to allow a one trip operation to install the production string in a wellbore while maintaining at least two fluidic seals between the subterranean zone and the terranean surface.

* * * * *

UNITED STATES PATENT AND TRADEMARK OFFICE

CERTIFICATE OF CORRECTION

PATENT NO. : 9,127,522 B2
APPLICATION NO. : 13/056958
DATED : September 8, 2015
INVENTOR(S) : Ian K. Kent and Stewart R. Hollett It is certified that error appears in the above-identified patent and that said Letters Patent is hereby corrected as shown below:

In the Claims
Column 12, Line 11, replace “engagable” with -- engageable --

Signed and Sealed this
Third Day of May, 2016

Michelle K. Lee

Michelle K. Lee
*Director of the United States Patent and Trademark Office*